US011402768B2

(12) United States Patent
Weyant et al.

(10) Patent No.: US 11,402,768 B2
(45) Date of Patent: Aug. 2, 2022

(54) PRINT MATERIAL AGITATORS COUPLED TO TABS

(71) Applicant: HEWLETT-PACKARD DEVELOPMENT COMPANY, L.P., Spring, TX (US)

(72) Inventors: Andie Zoeller Weyant, Boise, ID (US); Jeffrey Harold Luke, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/260,482

(22) PCT Filed: Nov. 13, 2018

(86) PCT No.: PCT/US2018/060630

§ 371 (c)(1),
(2) Date: Jan. 14, 2021

(87) PCT Pub. No.: WO2020/101645

PCT Pub. Date: May 22, 2020

(65) Prior Publication Data

US 2021/0318644 A1 Oct. 14, 2021

(51) Int. Cl.
*G03G 15/08* (2006.01)

(52) U.S. Cl.
CPC ..... *G03G 15/0889* (2013.01); *G03G 15/0865* (2013.01); *G03G 2215/085* (2013.01); *G03G 2215/0819* (2013.01); *G03G 2215/0852* (2013.01)

(58) Field of Classification Search
CPC ..... G03G 15/0889; G03G 15/0865; G03G 2215/085; G03G 2215/0819; G03G 15/0887; G03G 2215/0852; G03G 2215/0816; G03G 2215/066; G03G 2215/068; G03G 2215/0692
See application file for complete search history.

(56) References Cited

U.S. PATENT DOCUMENTS

| | | | | |
|---|---|---|---|---|
| 4,212,264 | A | 7/1980 | Knechtel et al. | |
| 5,489,976 | A | 2/1996 | Ichikawa | |
| 5,655,195 | A | 8/1997 | Ichikawa et al. | |
| 5,978,632 | A * | 11/1999 | Kimura | G03G 15/0855 222/409 |
| 6,603,933 | B1 * | 8/2003 | Foegelle | G03G 15/0872 399/109 |
| 6,609,820 | B2 | 8/2003 | Litwiller | |
| 7,174,123 | B1 * | 2/2007 | Miller | G03G 21/12 399/263 |

(Continued)

FOREIGN PATENT DOCUMENTS

EP 0784250 A2 7/1997

*Primary Examiner* — Walter L Lindsay, Jr.
*Assistant Examiner* — Laura Roth
(74) *Attorney, Agent, or Firm* — Trop Pruner & Hu, P.C.

(57) ABSTRACT

A print material cartridge (215) that includes a reservoir to maintain an amount of print material (Toner) therein; an agitator (230) formed within the reservoir to fragment clumps of print material present in the reservoir; and a tab (235) mechanically coupled to the agitator via a gear system (240), the tab extending out of a housing of the print material cartridge to activate the agitator as the print material cartridge is being interfaced with a printing device (205, 410).

17 Claims, 5 Drawing Sheets

(56) References Cited

U.S. PATENT DOCUMENTS

| | | | | |
|---|---|---|---|---|
| 7,978,989 | B2 * | 7/2011 | Nagano | G03G 15/0868 399/27 |
| 8,233,834 | B2 | 7/2012 | Horrall et al. | |
| 8,676,073 | B2 | 3/2014 | Murata et al. | |
| 8,995,889 | B2 | 3/2015 | Leemhuis | |
| 9,904,212 | B2 | 2/2018 | Meneses | |
| 2004/0126143 | A1 | 7/2004 | Blanck | |
| 2005/0163545 | A1 | 7/2005 | Cook et al. | |
| 2013/0084081 | A1 * | 4/2013 | Itabashi | G03G 21/1867 399/12 |
| 2014/0161489 | A1 * | 6/2014 | Niikawa | G03G 21/1857 399/167 |
| 2015/0185691 | A1 * | 7/2015 | Itabashi | G03G 15/0865 399/263 |
| 2016/0187813 | A1 * | 6/2016 | Nagura | G03G 15/0893 399/258 |
| 2016/0306294 | A1 * | 10/2016 | Nagura | G03G 15/0893 |

* cited by examiner

PRINT MATERIAL AGITATORS COUPLED TO TABS

BACKGROUND

Print material cartridges provide a source of print material to a printing device. The toner may be any type of print material that may be used to develop an image on the surface of a sheet of media or a three-dimensional (3D) object. In either example, a print material cartridge may be selectively interfaced with the printing device in order to be used as the source of the print material to the printing device.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
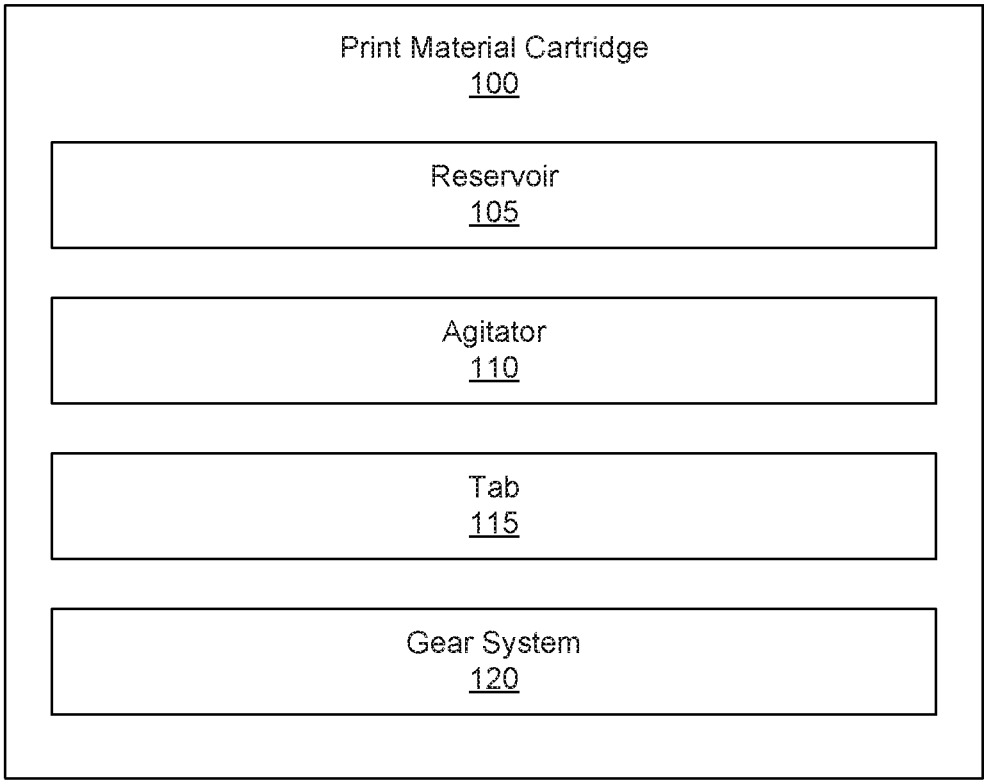
FIG. 1 is a block diagram of a print material cartridge according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Print materials such as toners and other powders may be used to develop two-dimensional (2D) images on a sheet of media and/or develop three-dimensional (3D) objects using a printing device. The print materials may be introduced to the printing device using a cartridge. The cartridge may provide a continuous amount of print material to the printing device so that the images or objects may be formed.

Because print materials such as toner may be in powder form, the small particles of the print material may clump together. This may be due to a number of factors including compaction of the print material within the print material cartridge during transport, gravitational effects on the print material, high humidity, and high temperatures, among others. Still further, as the print material is consumed, the flowability of the print material out of the print material cartridge may be reduced should the remaining portion of the print material is not evenly distributed within the print material cartridge. The flowability of the print material from the print material cartridge to the printing device may result in improper functioning of the print material cartridge and/or printing device. The may lead to print defects on the print media, print material level sensor failures, and/or excessive torque on motors within the printing device, among others.

As such, the print material within the print material cartridge may be stirred occasionally during use of the print material cartridge so as to prevent the print material from clumping together. However, such stirring may not occur initially as the print material cartridge is inserted into the printing device. A user may attempt to shake the print material cartridge but such shaking may damage the print material cartridge, be insufficient to break up the clumps of print material, and/or discharge the print material out of the print material cartridge while being shook.

The present specification describes a print material cartridge that includes a reservoir to maintain an amount of print material therein; an agitator formed within the reservoir to fragment clumps of print material present in the reservoir; and a tab mechanically coupled to the agitator via a gear system, the tab extending out of a housing of the print material cartridge to activate the agitator as the print material cartridge is being interfaced with a printing device.

The present specification further describes a printing system that includes a printing device comprising a print material cartridge port; a print material cartridge that includes a print material reservoir; a tab formed through a portion of the print material cartridge; and an agitator formed within the reservoir mechanically moveable and coupled to the tab via a gear system; wherein movement of the tab via introduction of the print material cartridge into the print material cartridge port causes the agitator to move within the print material reservoir.

The present specification also describes a toner agitator that includes a lattice structure formed along a transverse direction within a print toner cartridge; and a shovel member formed on a side of the lattice structure; wherein movement of the toner agitator through a reservoir of the print toner cartridge causes the shovel member to lift a portion of an amount of toner and pass the amount of toner behind the lattice structure.

Turning now to the figures, FIG. 1 is a block diagram of a print material cartridge (100) according to an example of the principles described herein. The print material cartridge (100) may be any type of cartridge that maintains an amount of print material therein. The print material may be provided by the print material cartridge (100) to a printing device when the print material cartridge (100) is interfaced with the printing device. The print material cartridge (100) may maintain any type of print material including any print material that may be used to print any of a two-dimensional (2D) image or create a three-dimensional (3D) object. This includes powder toners, and plastics, among others. For convenience of explanation, the print material maintained by the print material cartridge (100) may be referred to as a toner. In these examples and others, the print material cartridge (100) may be used to break up clumps of print material that may have formed within the print material cartridge (100). The clumps may form as a result of non-use of the printing device, transportation of the print material cartridge (100), and gravity, among other factors that may cause the print material to clump together.

The print material cartridge (100) may include a reservoir (105). The reservoir (105) may be of any size to maintain, within the print material cartridge (100), an amount of print material therein. In an example, the shape of the reservoir (105) may be cuboidal. The size and shape of the reservoir (105), however, may be dependent on the size and shape of the print material cartridge (100) and/or a print material cartridge port within a printing device the print material cartridge (100) is to be used to interface with the printing device.

Within the reservoir (105) may be formed an agitator (110). The agitator (110) may be used by the print material cartridge (100) to break up any clumps of print material that may occasionally form within the reservoir (105). In an example, the agitator (110) may include a lattice structure that, as the agitator (110) passes through the print material, cuts through the print material to break up the clumps of print material. The boundaries of the lattice structure of the agitator (110) may conform with any internal walls of the reservoir (105) so as to be able to rake through the entirety of any print material within the reservoir (105).

Figure 5:
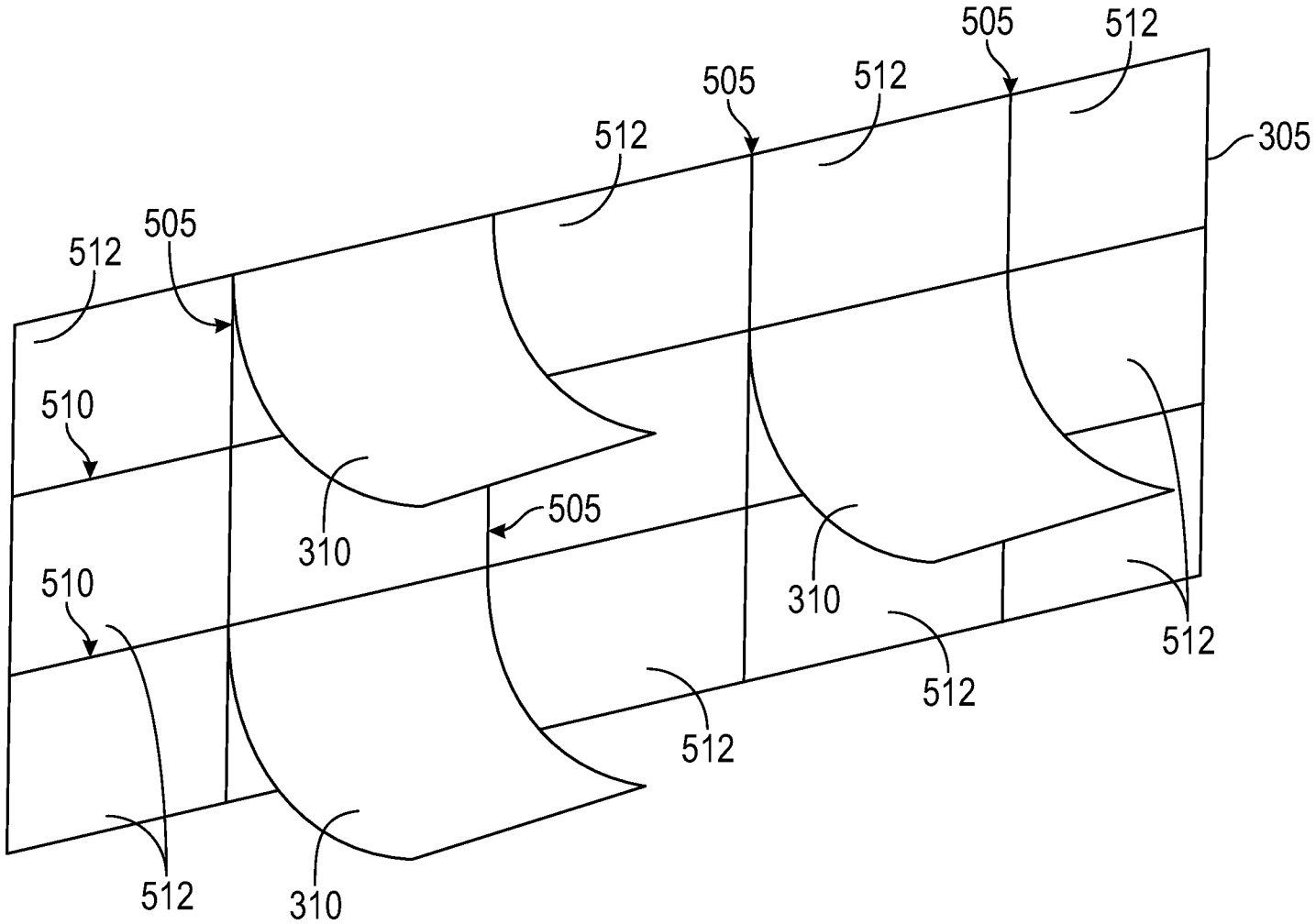
FIG. 5 shows a perspective view of the agitator of FIG. 4 according to an example of the principles described herein.

In an example, the agitator (110) may include a number of shovel members (e.g., 310 in FIG. 5). The shovel members may shovel the print material behind the agitator (110) as the agitator (110) is passed through the print material within the reservoir (105). In the example where the agitator (110) includes a lattice structure (e.g., 305 in FIG. 5), the shovel members may shovel the print material through any voids (e.g., 512) formed by the lattice of the lattice structure. This allows for the lattice structure to both cut through the print material while the shovel members shovel and turn up the print material within the reservoir (105).

The print material cartridge (100) may include a tab (115). The tab (115) may be any extension out of the housing (e.g., 422 in FIG. 4) of the print material cartridge (100) that is coupled, mechanically, to a gear system (120) within the print material cartridge (100). The gear system (120) may, in turn, be mechanically coupled to the agitator (110) such that actuation of the tab (115) causes the agitator (110) to move within the reservoir (105). In an example, the actuation of the tab (115) is caused when the print material cartridge (100) is interfaced with a printing device. In this example, as a user interfaces the print material cartridge (100) with, for example a print material cartridge port, the tab (115) may mechanically interface with a rail within the port moving the tab (115) along a side wall of the print material cartridge (100). In this example, the tab (115) may follow a trench formed through the housing of the print material cartridge (100). As the tab (115) is actuated via the movement along the housing of the print material cartridge (100), the gear system (120) may be activated so as to move the agitator (110) through the reservoir (105) and the print material therein. The gear system (120) may be coupled to the tab (115) via, for example, a pull cord so that as the tab (115) pulls the pull cord, the gears within the gear system (120) move activating the movement of the agitator (110). In an example, the agitator (110) may also be coupled to the gear system (120) using a pull cord or other type of devices such as a drive belt (e.g., 420 in FIG. 4).

In an example, the actuation of the tab (115) may be accomplished by the printing device on a semiautomatic or automatic basis. In the example where the printing device actuates the tab (115) on a semiautomatic basis, a user may access a user interface associated with the printing device and press a button in order to cause the printing device to actuate the tab (115) as described herein. Thus, the agitator (110) within the print material cartridge (100) may be moved through the reservoir when the user interfaces the print material cartridge (100) with the printing device and may continually be moved any additional number of times via the printing device interface. In an example, the user interface of the printing device may present a warning or other notification indicating to a user that the print material within the print material cartridge (100) should be agitated and that the user should select the option to cause the printing device to interact with the tab (115) as described herein.

In an example, the actuation of the tab (115) may be accomplished on an automatic basis. In this example, an initial stirring or agitation of the print material within the print material cartridge (100) may occur when the user interfaces the print material cartridge (100) with the printing device as described herein. The printing device may also monitor the print material output from the print material cartridge (100) and determine, based on a number of factors, if and when the agitation of the print material by the agitator (110) should take place. In an example, a reduction of print material output from the print material cartridge (100) may automatically cause the print device to interface with the tab (115) in order to cause the gear system (120) to drive the agitator (110) as described herein. In any example presented herein, when the printing device interacts with the tab (115), a dedicated drive mechanism may move the tab (115) as descried herein. The drive mechanism may include any arm or other mechanical device having a driving interface to interact with the tab (115) in order to move it. In addition, the drive mechanism may include a motor that moves the mechanical device against the tab (115) to move the tab (115).

Figure 2:
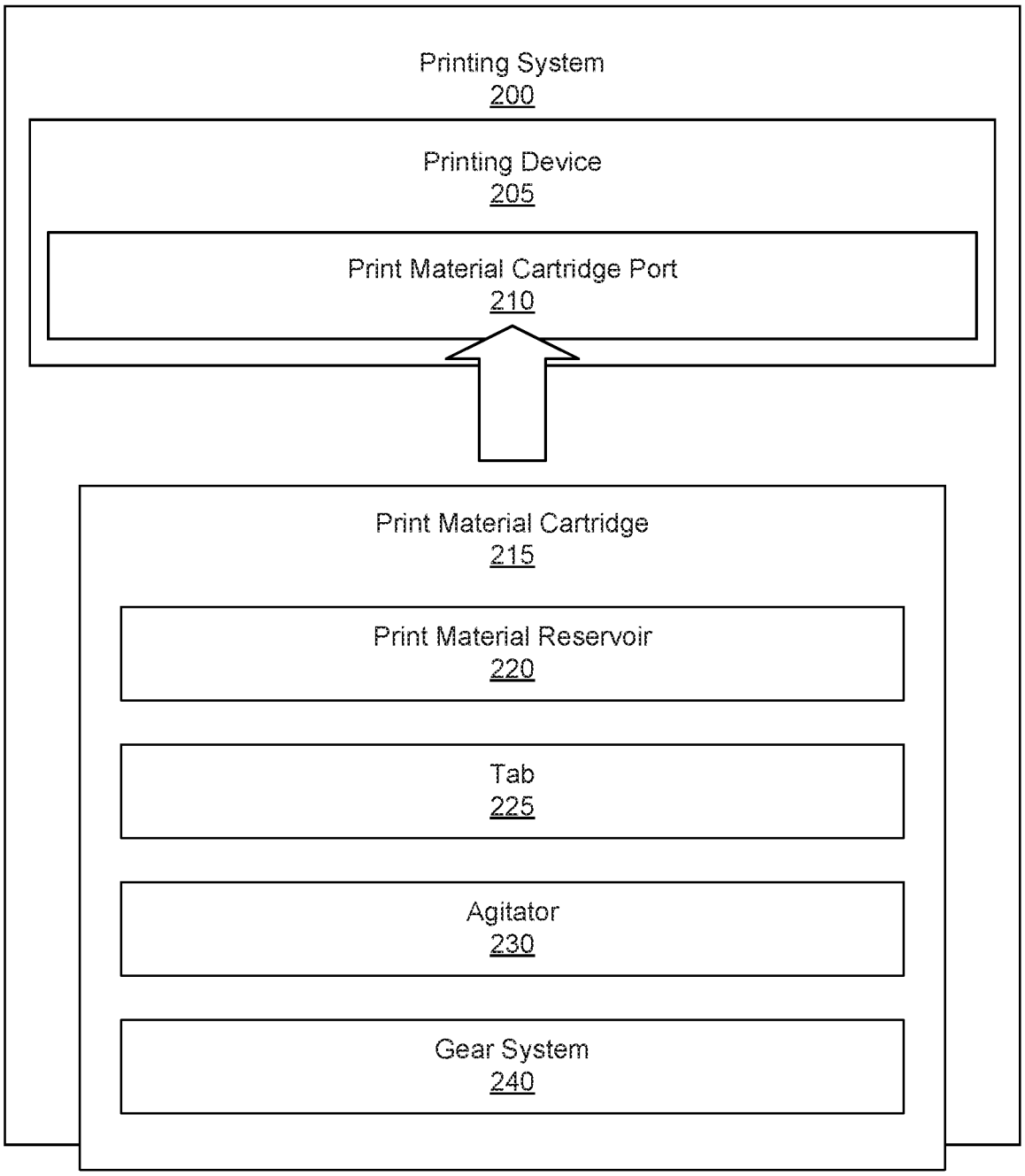
FIG. 2 is a block diagram of a printing system according to an example of the principles described herein.

FIG. 2 is a block diagram of a printing system (200) according to an example of the principles described herein. The printing system (200) may include a printing device (205) and a print material cartridge (215). In an example, the print material cartridge (215) may be selectively interfaced with the printing device (205) via a print material cartridge port (210). In an example, the print material cartridge port (210) may be formed so as to receive the specific shape and size of the print material cartridge (215). In an example, the print material cartridge port (210) may be formed to receive a plurality of differently shaped and/or sized print material cartridges (215). In an example, the selective removal of the print material cartridge (215) from the print material cartridge port (210) may be accomplished by a user and/or mechanical device of the printing device.

The print material cartridge (215) may include a print material reservoir (220) to maintain an amount of print material therein. As described herein in connection with FIG. 1, the print material cartridge (215) may include a tab (225), an agitator (230), and a gear system (240) mechanically coupling the tab (225) to the agitator (230). The mechanical coupling of the tab (225) to the agitator (230) via the gear system (240) allows the agitator (230) to be passed through print material maintained in the print material reservoir (220) when the tab (225) is moved.

In an example, the tab (225) may extend out from the print material cartridge (215) and be placed within a channel formed along an outer surface of the print material cartridge (215). The tab (225) may be allowed to move within the channel formed. The tab (225) may be coupled to the gear system (240) via, for example, a belt system (e.g., 424 in FIG. 4) such that as the tab (225) is moved within the channel, the belt rotates a number of gears within the gear system (240). Accordingly, the rotation of the gears may also cause the agitator (230) within the print material reservoir (220) to move via, for example, a belt. Thus, in this example, direct movement of the tab (225) along an outer wall of the print material cartridge (215) causes the agitator (230) to be moved as well through the use of the gear system (240). The gear system (240) may impart any mechanical advantage to the agitator (230) through the use of various gear ratios. Indeed, in an example, the gear system (240) may impose an output torque on the belt coupled to the agitator (230) such that movement of the tab (225) multiplies the force on the belt coupled to the agitator (230). This allows for relatively easy movement of the tab (225) being translated into easy movement of the agitator (230) through the print material within the print material reservoir (220).

The movement of the tab (225) may be caused, in an example, by a user moving the tab (225) with the user's fingers. In this example, the tab may be grasped by the user and the user may move the tab (225) back and forth along the exterior wall of the print material cartridge (215).

In an example, the movement of the tab (225) may be caused as the print material cartridge (215) is interfaced with the print material cartridge port (210). In this example, the print material cartridge port (210) of the printing device (205) may include a rail system that both supports the print material cartridge (215) and interfaces with the print material cartridge (215). As the print material cartridge (215) slides along these rails, the tab (225) may interface or otherwise abut against a portion of the rails such that as the print material cartridge (215) moves into the print material cartridge port (210), the tab (225) remains still thereby moving relative to the print material cartridge (215). In an example, as the tab (225) reaches the end of the exterior wall of the print material cartridge (215) and/or as the insertion of the print material cartridge (215) into the print material cartridge port (210) is completed, the tab (225) may return to the location where it was along the exterior wall of the print material cartridge (215) prior to installation. The tab (225) may return to that position through the use of a spring.

As described herein and as the print material cartridge (215) is completely installed in the print material cartridge port (210), the printing device (205) may include any mechanical device such as an arm that moves the tab (225) either on an automatic or semi-automatic basis. In the example where the printing device (205) actuates the tab (225) on a semiautomatic basis, a user may access a user interface associated with the printing device (205) and press a button in order to cause the printing device (205) to actuate the tab (225) as described herein. Thus, the agitator (230) within the print material cartridge (215) may be moved through the print material reservoir (220) when the user interfaces the print material cartridge (215) with the print material cartridge port (210) of the printing device (205) and may continually be moved any additional number of times via the interface of the printing device (205). In an example, the user interface of the printing device (205) may present a warning or other notification indicating to a user that the print material within the print material cartridge (215) should be agitated and that the user should select the option to cause the printing device (205) to interact with the tab (225) as described herein.

In an example, the actuation of the tab (225) may be accomplished on an automatic basis. In this example, an initial stirring or agitation of the print material within print material reservoir (220) may occur when the user interfaces the print material cartridge (215) with the printing device (205) as described herein. The printing device (205) may also monitor the print material output from the print material cartridge (215) and determine, based on a number of factors, if and when the agitation of the print material by the agitator (230) should take place. In an example, a reduction of print material output from the print material cartridge (215) may automatically cause the printing device (205) to interface with the tab (225) in order to cause the gear system (240) to drive the agitator (230) as described herein. In any example presented herein, when the printing device (205) interacts with the tab (225), a dedicated drive mechanism may move the tab (225). The drive mechanism may include any arm (e.g., a mechanical arm 410 shown in FIG. 4) or other mechanical device having a driving interface to interact with the tab (225) in order to move it. In addition, the drive mechanism may include the motor (426) that moves the mechanical device against the tab (225) to move the tab (225).

In an example, the agitation of the print material within the print material reservoir (220) may be accomplished by a continuous insertion and reinsertion of the print material cartridge (215) into the print material cartridge port (210). In this example, a user may initially insert the print material cartridge (215) into the print material cartridge port (210) causing the rails within the print material cartridge port (210) to interact with the tab (225) as described herein. The user may then remove the print material cartridge (215) from the print material cartridge port (210) and reinsert the print material cartridge (215) again into the print material cartridge port (210). This may be done any number of times so that complete agitation of the print material within the print material reservoir (220) is accomplished.

Figure 3:
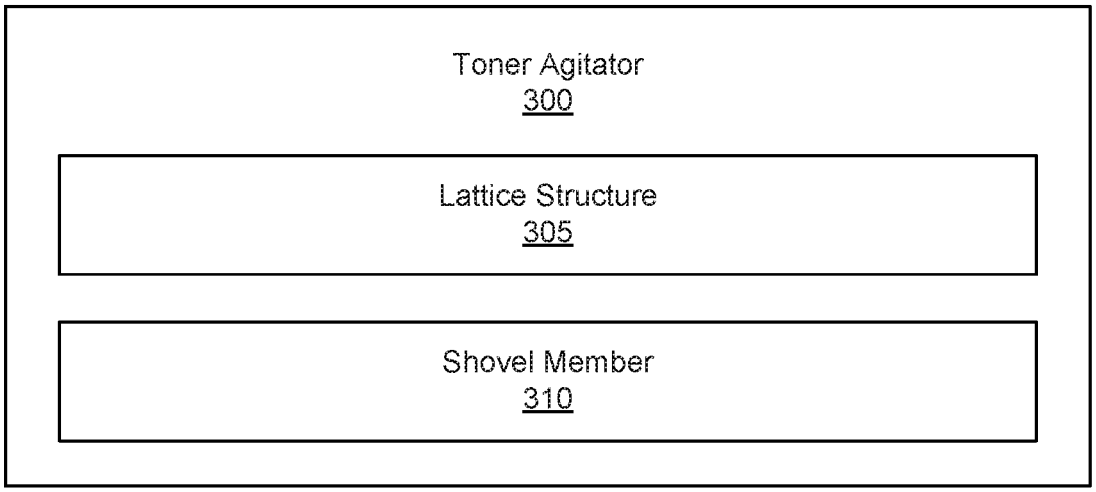
FIG. 3 is a block diagram of a toner agitator according to an example of the principles described herein.

FIG. 3 is a block diagram of a toner agitator (300) according to an example of the principles described herein. In an example, the toner agitator (300) may include the lattice structure (305) and any number of shovel members (310). As described herein, the lattice structure (305) may be formed large enough to conform to the interior walls of the print material reservoir (220). That is, the lattice structure (305) may reach the edges of the interior walls of the print material reservoir (220) so that as the lattice structure (305) passes through the print material reservoir (220), all the print material is addressed and de-clumped by the lattice structure (305). In an example, the lattice structure (305) is along a single cross-cut plane within the print material reservoir (220).

The lattice structure (305) may include any number of horizontal and/or vertical members. The horizontal and vertical members may cut through the print material so that the print material may be de-clumped. The number of both the vertical and horizontal members may depend on the type of print material within the print material reservoir (220) as well as the clumping characteristics or proclivities of the print material.

This lattice structure (305) may further include any number of shovel members (310). As described herein, the shovel members (310) may be coupled to the lattice structure (305) and extend out from the lattice structure (305) in the direction the lattice structure (305) is to move through the print material. In this arrangement, the shovel members (310) may pick up any amount of print material and turn up the print material as the lattice structure (305) passes through the print material reservoir (220). In an example, the shovel members (310) may also shovel an amount of print material through the lattice structure (305) and behind the lattice structure (305) as it passes through the print material.

Figure 4:
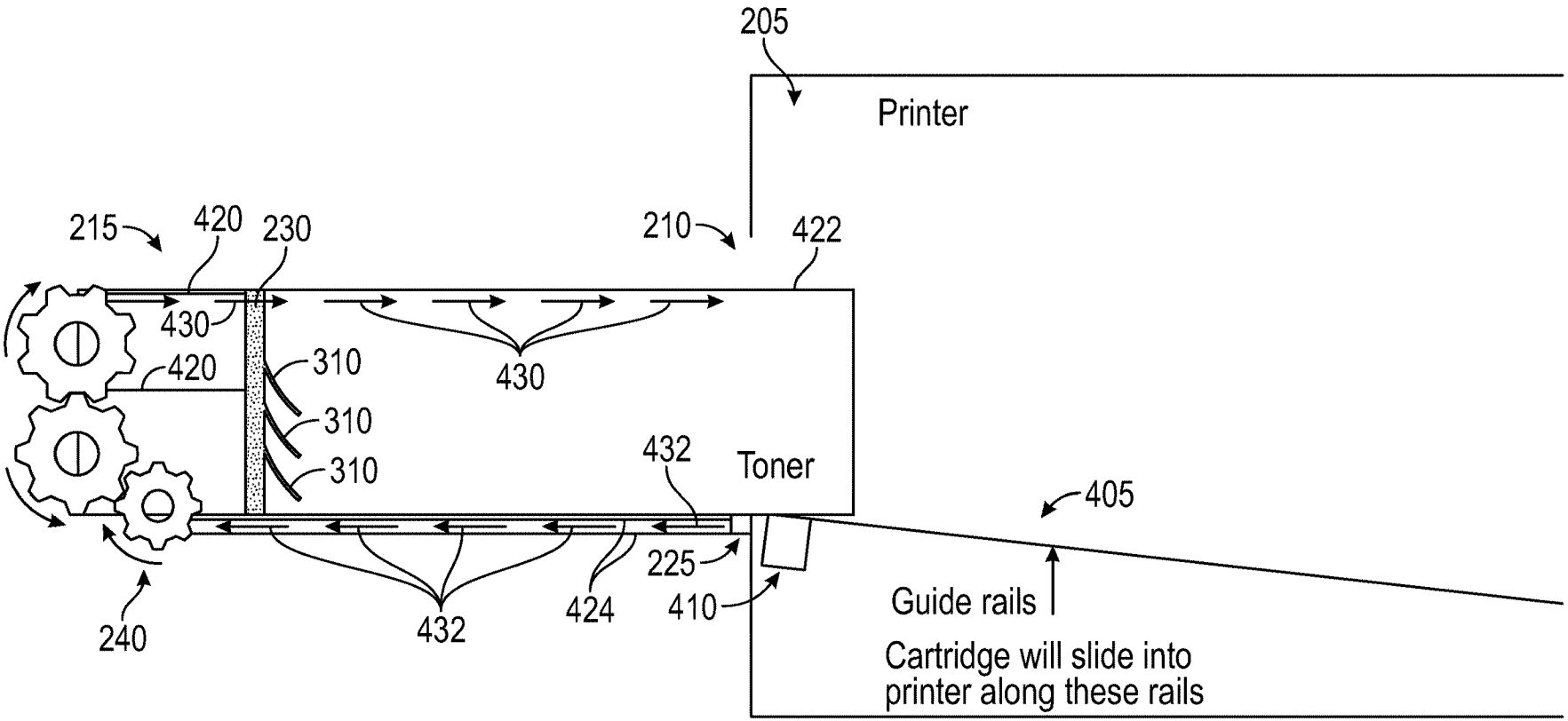
FIG. 4 is a side cutout view of a print material cartridge interfacing with a printing device according to an example of the principles described herein.

FIG. 4 is a side cutout view of a print material cartridge (215) interfacing with a printing device (205) according to an example of the principles described herein. In this example, the print material cartridge (215) may interface with the printing device (205) at a print material cartridge port (210) as described herein. The interfacing of the print material cartridge (215) at the print material cartridge port (210) may include placing the print material cartridge (215) on a number of guide rails (405). The guide rails (405) may guide the print material cartridge (215) into the print material cartridge port (210) and cause the print material cartridge (215) to rest at an appropriate location within the print material cartridge port (210) for use by the printing device (205).

In this example, the guide rails (405) may further include a mechanical arm (410) that interfaces with the tab (225) of the print material cartridge (215). By passing the print material cartridge (215) into the print material cartridge port (210), the mechanical arm (410) abuts the tab (225) so that the tab (225) may not progress into the print material cartridge port (210) with the print material cartridge (215). Thus, the tab (225) is moved relative to the print material cartridge (215) causing the activation of the gear system (240) as described herein.

FIG. 4 also shows the interior parts of the print material cartridge (215) including the gear system (240) and agitator (230). As described herein, the tab (225) may be mechanically coupled to the gear system (240) via a pull cord or belt. Similarly, the agitator (230) may be coupled to the gear system (240) via a pull cord or belt (420). In these examples, the movement of the tab (225) is translated into movement of the agitator (230). In the specific example, shown in FIG. 4, the movement of the tab (225) relative to the agitator (230) is in opposite directions (e.g., arrows 430 depict a direction of movement of the agitator 230, and arrows 432 depict an opposite direction of movement of the tab 225). However, this is merely an example, and the present specification contemplates that movement of the tab (225) in any direction may cause movement of the agitator (230) in any direction. It is further contemplated, however, that any movement of the tab (225) causes any movement of the agitator (230) through the print material within the print material reservoir (220) as described herein. Additionally, the gear system (240) as shown may include any number of gears that allows for the movement of the agitator (230) when the tab (225) is moved. In a specific example, the torque placed on the agitator (230) may be created by various gear ratios. In this example, the increased torque may allow the agitator (230) to be pushed through relatively large amounts of print material with minimal effort used to move the tab (225).

As depicted in the FIG. 4, the agitator (230) may include a lattice structure (305) and a number of shovel members (310). FIG. 5 shows a perspective view of the agitator (230) of FIG. 4 according to an example of the principles described herein. As described herein, the agitator (230) may include a number of vertical members (505) and/or horizontal members (510). The number of vertical members (505) and/or horizontal members (510) within the lattice structure (305) of the agitator (230) may depend on a number of factors including the type of material the agitator (230) is made of, the amount of print material to be agitated by the agitator (230), and the interior size of the print material reservoir (220), among others.

The agitator (230) may include a number of shovel members (310). The number and placement of the shovel members (310) may be varied and again depend on the type of material the shovel members (310) are made of, the amount of print material to be agitated by the agitator (230), and the interior size of the print material reservoir (220), among others. As described herein, the shovel members (310) may scoop up an amount of print material within the print material reservoir (220) as the agitator (230) is moved through the print material reservoir (220). By doing so, the shovel members (310) agitate the print material by churring up the print material. In an example, the shovel members (310) may pass an amount of print material through the lattice structure (305) of the agitator (230) and behind it as the agitator (230) passes through the print material reservoir (220).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, a processor of the printing device or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe an agitator and print material cartridge that agitates print material therein under a number of different circumstances. Some examples of the use of the print material cartridge described herein may implement user interaction, mechanical interaction from the printing device, and/or a combination of both user interaction and mechanical interaction. This allows for the print material to be de-clumped and agitated. By mechanically agitating the print material, this decreases the variability of a de-clumping process and ensures that damage to the print material cartridge does not occur. A user does not shake the print material cartridge but instead interfaces the print material cartridge with the printing device in order to agitate the print material. Indeed, under a fully automatic process, the printing system may detect the output of the print material from the print material cartridge and conduct an agitation process as described herein.

The preceding description has been presented to illustrate and describe examples of the principles described. This description is not intended to be exhaustive or to limit these principles to any precise form disclosed. Many modifications and variations are possible in light of the above teaching.

What is claimed is:

1. A print material cartridge, comprising:

a housing;

a reservoir to contain a print material;

an agitator within the reservoir to fragment clumps of the print material present in the reservoir;

a gear system; and a tab mechanically coupled to the agitator via the gear system, the tab protruding from outside the housing of the print material cartridge to activate the agitator as the print material cartridge is being interfaced with a printing device, the tab to cause a sliding motion of the agitator inside the reservoir, the agitator comprising a shovel member to shovel an amount of the print material as the agitator slides inside the reservoir.

2. The print material cartridge of claim 1, wherein the agitator is actuated by movement of the tab along the housing of the print material cartridge.

3. The print material cartridge of claim 1, wherein interfacing of the print material cartridge with the printing device causes the tab to be moved along a wall of the housing of the print material cartridge causing an actuation of the agitator.

4. The print material cartridge of claim 1, wherein the tab, when the print material cartridge is interfaced with the printing device, interfaces with a drive interface to move the tab along the housing of the print material cartridge to actuate the agitator.

5. The print material cartridge of claim 1, wherein the agitator comprises a lattice structure within the housing.

6. The print material cartridge of claim 1, wherein the agitator is to slide along a length of the housing.

7. The print material cartridge of claim 1, wherein the shovel member is to shovel the amount of the print material through a void in the agitator and behind the agitator as the agitator slides inside the reservoir.

8. The print material cartridge of claim 1, wherein the agitator comprises a lattice structure formed with vertical members and horizontal members.

9. The print material cartridge of claim 8, wherein the vertical members and the horizontal members define voids through which the amount of the print material shoveled by the shovel member passes as the agitator slides inside the reservoir.

10. The print material cartridge of claim 8, wherein the shovel member is curved.

11. A printing system, comprising:

a printing device comprising a print material cartridge port;

a print material cartridge comprising:

a print material reservoir;

a tab that protrudes from an outside of the print material cartridge; and an agitator within the print material reservoir mechanically moveable and coupled to the tab via a gear system;

wherein movement of the tab via introduction of the print material cartridge into the print material cartridge port causes the agitator to slide within the print material reservoir.

12. The printing system of claim 11, wherein the movement of the tab in a direction causes sliding of the agitator in an opposite direction.

13. The printing system of claim 11, further comprising a drive member to interface with the tab and move the tab.

14. The printing system of claim 13, where the drive member is affixed to a portion of rails formed within the print material cartridge port.

15. The printing system of claim 11, wherein the agitator comprising a shovel member to shovel an amount of a print material as the agitator slides inside the print material reservoir.

16. The printing system of claim 15, wherein the agitator comprises a lattice structure formed with vertical members and horizontal members.

17. The printing system of claim 16, wherein the vertical members and the horizontal members define voids through which the amount of the print material shoveled by the shovel member passes as the agitator slides inside the print material reservoir.

* * * * *